US005551096A

United States Patent [19]

Gardner

[11] Patent Number: 5,551,096

[45] Date of Patent: Sep. 3, 1996

[54] DISPOSABLE TOILET SEAT COVER APPARATUS

[76] Inventor: G. Byron Gardner, 98 Wadsworth, Ste. 127–195, Lakewood, Colo. 80226

[21] Appl. No.: 452,684

[22] Filed: May 30, 1995

[51] Int. Cl.[6] ..... A47K 13/18; A47K 13/22

[52] U.S. Cl. ..... 4/245.4; 4/245.8; 4/244.2

[58] Field of Search ..... 4/245.1, 245.3, 4/245.4, 245.5, 245.6, 245.8, 244.2

[56] References Cited

U.S. PATENT DOCUMENTS

| | | | |
|---|---|---|---|
| 1,037,062 | 8/1912 | Seyl | 4/244.2 |
| 1,121,015 | 12/1914 | Hunter | 4/244.2 |
| 3,753,262 | 8/1973 | Watsky | 4/244.2 |
| 4,627,117 | 12/1986 | Morishita | 4/245.8 |
| 4,766,617 | 8/1988 | Thygeseu et al. | 4/245.4 |
| 4,887,321 | 12/1989 | MacLean | 4/245.8 |

*Primary Examiner*—Henry J. Recla

*Assistant Examiner*—Charles R. Eloshway

[57] ABSTRACT

A disposable toilet seat cover apparatus includes a continuous, flexible, biodegradable base sheet which has two side edges, a leading edge, a top side, and a bottom side. The base sheet includes a plurality of sets of perforations positioned at predetermined intervals along the base sheet, wherein each set of the perforations extends across the base sheet from one side edge to the other side edge. A coating of tacky adhesive is placed on the bottom side of the base sheet and is coextensive with the bottom side of the base sheet. The base sheet with the tacky adhesive on the bottom side of the base sheet is wound into a roll whereby portions of the tacky adhesive contact portions of the top side of the base sheet. As a result, the roll is maintained as a compact roll. The roll is unrolled by pulling the leading edge of the base sheet away from the roll. The coating of tacky adhesive is water repellent. The base sheet is made from a relatively non-porous paper. By using the disposable toilet seat cover apparatus, a method of covering a horse-shoe shaped toilet seat is provided. In addition, a method is provided for covering an oval shaped toilet seat.

2 Claims, 3 Drawing Sheets

DISPOSABLE TOILET SEAT COVER APPARATUS

BACKGROUND OF THE INVENTION

1. Field of the Invention

The present invention relates generally to disposable toilet seat covers and, more particularly, to disposable toilet seat covers carried on a roll and dispensed therefrom.

2. Description of the Prior Art

For sanitation purposes, disposable toilet seat covers are often employed. Throughout the years, a number of innovations have been developed relating to disposable toilet seat cover, and the following U.S. patents are representative of some of those innovations: U.S. Pat. Nos. 1,125,847; 1,846,960; 2,260,404; 2,313,311; and 4,627,117.

More specifically, U.S. Pat. No. 1,125,847 discloses a toilet seat cover that is dispensed on a roll like toilet paper. The toilet seat cover must be unfolded from the roll in order to be used on the toilet seat. To avoid the inconvenience attendant with unfolding the toilet paper, it would be desirable if a toilet seat cover were adapted for covering a toilet seat without unfolding the toilet seat cover. The toilet paper disclosed in U.S. Pat. No. 1,125,847 is water absorbent. As a result, liquids that are on the toilet seat, such as from a previous person, can migrate up through the toilet paper and contact the person using the disposable toilet seat cover. With this in mind, it would be desirable if a disposable toilet seat cover prevents migration of liquids from the toilet seat to a person using the disposable toilet seat cover.

U.S. Pat. No. 1,846,960 discloses a waterproof toilet seat cover which uses a waterproof sheet of material that will not break down when flushed. So as not to cause damage to sewage handling systems, it would be desirable if a toilet seat cover were made from materials that break down when flushed. Furthermore, U.S. Pat. No. 1,846,960 has a specific size and shape to cover a toilet seat. The overall shape of the toilet seat cover is doughnut shaped. Such a shape is difficult to manufacture. In this respect, it would be desirable if a toilet seat cover were provided for coveting a toilet seat without having a doughnut-shaped toilet seat cover.

U.S. Pat. No. 2,260,404 discloses a non-flushable toilet seat cover which does not prevent migration of liquids from the toilet seat to a person using the toilet seat cover. Moreover, when stored before use, this toilet seat cover has a relatively large surface area. As a result, such a toilet seat cover would be impractical to carry in a pocket or pocket book. If a toilet seat cover can be readily carried in a pocket or a pocket book, the toilet seat cover is readily portable and can be used any time it is needed. For convenience, it would be desirable if a toilet seat cover were easily portable and could readily be carried in a pocket or pocket book.

U.S. Pat. No. 2,313,311 discloses the use of a sticky strip in a disposable toilet seat cover. The sticky strip is applied to a small portion of the toilet seat cover to provide a frictional resistance between the toilet seat cover and the toilet seat. Because the sticky strip is applied to only a small portion of the toilet seat cover, the sticky strip cannot serve as a waterproof barrier to prevent migration of liquids from the toilet seat, through the toilet seat cover, to the person sitting on the toilet seat. Moreover, the type of adhesive selected in U.S. Pat. No. 2,313,311 requires the use of wax papers to be placed upon the stick strips for packaging. To avoid the extra cost and effort in employing wax paper barrier strips on toilet seat covers that have sticky material, it would be desirable if a toilet seat cover employed a type of adhesive that does not require the use of nonstick barrier strips between adjacent strips of adhesive. Also, to provide an extensive waterproof barrier between a wet toilet seat and a person using a disposable toilet seat cover, it would be desirable if a water repellent adhesive were applied extensively to one side of a toilet seat cover.

U.S. Pat. No. 4,627,117 discloses a roll of perforated paper that is dispensed for covering a toilet seat. As disclosed in U.S. Pat. No. 4,627,117, when the perforated paper is employed, the sides of the toilet seat are covered, but the middle of the front and the middle of the back of the toilet seat are not covered and remain exposed. In this respect, it would be desirable to disclose a way of using a perforated paper for covering the middle of the front and the middle of the back of a toilet seat. In addition, the paper disclosed in U.S. Pat. No. 4,627,117 has no means for providing enhanced frictional resistance between a toilet seat and the paper. Also, no provision is made for preventing migration of fluids from a toilet seat, through a disposable toilet seat cover, and onto a person using the disposable toilet seat cover. Moreover, even though the paper in U.S. Pat. No. 4,627,117 is in a form of a roll, no provision is made for keeping the roll tightly rolled. In this respect, it would be desirable if a roll of paper used for a toilet seat cover had a provision for keeping the roll of paper tightly rolled.

The frictional resistance between a typical toilet seat and typical toilet paper is quite low. As a result, when typical toilet paper is placed on a toilet seat, it can readily slide off of the seat. In this respect, it would be desirable if a toilet seat cover provided a substantial frictional resistance against the toilet seat.

Still other features would be desirable in a disposable toilet seat cover. For example, when the person using the disposable toilet seat cover is finished and when it is time to separate the toilet seat cover from the toilet seat, it would be desirable for the disposable toilet seat cover to be readily removed from the toilet seat.

Thus, while the foregoing body of prior art indicates it to be well known to use disposable toilet seat covers, the prior art described above does not teach or suggest a disposable toilet seat cover apparatus which has the following combination of desirable features: (1) is adapted to cover a toilet seat without unfolding the toilet seat cover; (2) prevents migration of liquids from the toilet seat to a person using the disposable toilet seat cover apparatus; (3) provides a substantial frictional resistance against the toilet seat; (4) is made from materials that break down when flushed; (5) does not have a doughnut-shaped toilet seat cover; (6) is easily portable and can readily be carried in a pocket, pocket book, or purse; (7) does not require the use of non-stick barrier strips between adjacent strips of adhesive; (8) employs a water-repellent adhesive applied extensively to one side of the toilet seat cover; (9) provides a way of using a perforated paper for covering the middle of the front and the middle of the back of a toilet seat; (10) has a provision for keeping a roll of paper tightly rolled; and (11) is readily removable from the toilet seat when it is time to separate the toilet seat cover from the toilet seat. The foregoing desired characteristics are provided by the unique disposable toilet seat cover apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a disposable toilet seat cover apparatus which includes a continuous, flexible, biodegradable base sheet which has two side edges, a leading edge, a top side, and a bottom side. The base sheet includes a plurality of sets of perforations positioned at predetermined intervals along the base sheet, wherein each set of the perforations extends across the base sheet from one side edge to the other side edge. A coating of tacky adhesive is placed on the bottom side of the base sheet and is coextensive with the bottom side of the base sheet. The base sheet with the tacky adhesive on the bottom side of the base sheet is wound into a roll whereby portions of the tacky adhesive contact portions of the top side of the base sheet. As a result, the roll is maintained as a compact roll. The roll is unrolled by pulling the leading edge of the base sheet away from the roll. The coating of tacky adhesive is water repellent. The base sheet is made from a relatively non-porous paper.

A method of covering a horse-shoe shaped toilet seat is provided. The method includes the steps of obtaining a roll of perforated disposable toilet seat cover segments and tearing off a first disposable toilet seat cover segment off of the roll. The first disposable toilet seat cover segment is long enough to substantially cover a first side of the horse-shoe shaped toilet seat. Then, the first disposable toilet seat cover segment is placed on the first side of the horse-shoe shaped toilet seat. A second disposable toilet seat cover segment is torn off of the roll. The second disposable toilet seat cover segment is long enough to substantially cover a second side of the horse-shoe shaped toilet seat. The second disposable toilet seat cover segment is placed on the second side of the horse-shoe shaped toilet seat. Then, a third disposable toilet seat cover segment is torn off of the roll. The third disposable toilet seat cover segment is long enough to substantially cover a back side of the horse-shoe shaped toilet seat. Then, the third disposable toilet seat cover segment is placed on the back side of the horse-shoe shaped toilet seat.

A method of covering an oval shaped toilet seat is provided. The method includes the steps of obtaining a roll of perforated disposable toilet seat cover segments and tearing off a first disposable toilet seat cover segment from the roll. The first disposable toilet seat cover segment is long enough to substantially cover a first side of the oval shaped toilet seat. The first disposable toilet seat cover segment is placed on the first side of the oval shaped toilet seat. Then, a second disposable toilet seat cover segment is torn off of the roll. The second disposable toilet seat cover segment is long enough to substantially cover a second side of the oval shaped toilet seat. Then, the second disposable toilet seat cover segment is placed on the second side of the oval shaped toilet seat. Then, a third disposable toilet seat cover segment is torn off of the roll. The third disposable toilet seat cover segment is long enough to substantially cover a back side of the oval shaped toilet seat. Then, the third disposable toilet seat cover segment is placed on the back side of the oval shaped toilet seat. Then, a fourth disposable toilet seat cover segment is torn off of the roll. The fourth disposable toilet seat cover segment is long enough to substantially cover a front side of the oval shaped toilet seat. Then, the fourth disposable toilet seat cover segment is placed on the front side of the oval shaped toilet seat.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved disposable toilet seat cover apparatus which has all of the advantages of the prior art and none of the disadvantages.

It is another object of the present invention to provide a new and improved disposable toilet seat cover apparatus which may be easily and efficiently manufactured and marketed.

It is a further object of the present invention to provide a new and improved disposable toilet seat cover apparatus which is of durable and reliable construction.

An even further object of the present invention is to provide a new and improved disposable toilet seat cover apparatus which is susceptible of a low cost of manufacture with regard to both materials and labor, and which accordingly is then susceptible of low prices of sale to the consuming public, thereby making such disposable toilet seat cover apparatus available to the buying public.

Still yet a further object of the present invention is to provide a new and improved disposable toilet seat cover apparatus which is adapted to cover a toilet seat without unfolding the toilet seat cover.

Still another object of the present invention is to provide a new and improved disposable toilet seat cover apparatus that prevents migration of liquids from the toilet seat to a person using the disposable toilet seat cover apparatus.

Yet another object of the present invention is to provide a new and improved disposable toilet seat cover apparatus which provides a substantial frictional resistance against the toilet seat.

Even another object of the present invention is to provide a new and improved disposable toilet seat cover apparatus that is made from materials that break down when flushed.

Still a further object of the present invention is to provide a new and improved disposable toilet seat cover apparatus which does not have a doughnut-shaped toilet seat cover.

Yet another object of the present invention is to provide a new and improved disposable toilet seat cover apparatus that is easily portable and can readily be carried in a pocket, pocket book, or purse.

Still another object of the present invention is to provide a new and improved disposable toilet seat cover apparatus which does not require the use of non-stick barrier strips between adjacent strips of adhesive.

Yet another object of the present invention is to provide a new and improved disposable toilet seat cover apparatus that employs a water-repellent adhesive applied extensively to one side of the toilet seat cover.

Still a further object of the present invention is to provide a new and improved disposable toilet seat cover apparatus that provides a way of using a perforated paper for covering the middle of the front and the middle of the back of a toilet seat.

Yet another object of the present invention is to provide a new and improved disposable toilet seat cover apparatus which has a provision for keeping a roll of paper tightly rolled.

Still a further object of the present invention is to provide a new and improved disposable toilet seat cover apparatus that is readily removable from the toilet seat when it is time to separate the toilet seat cover from the toilet seat.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
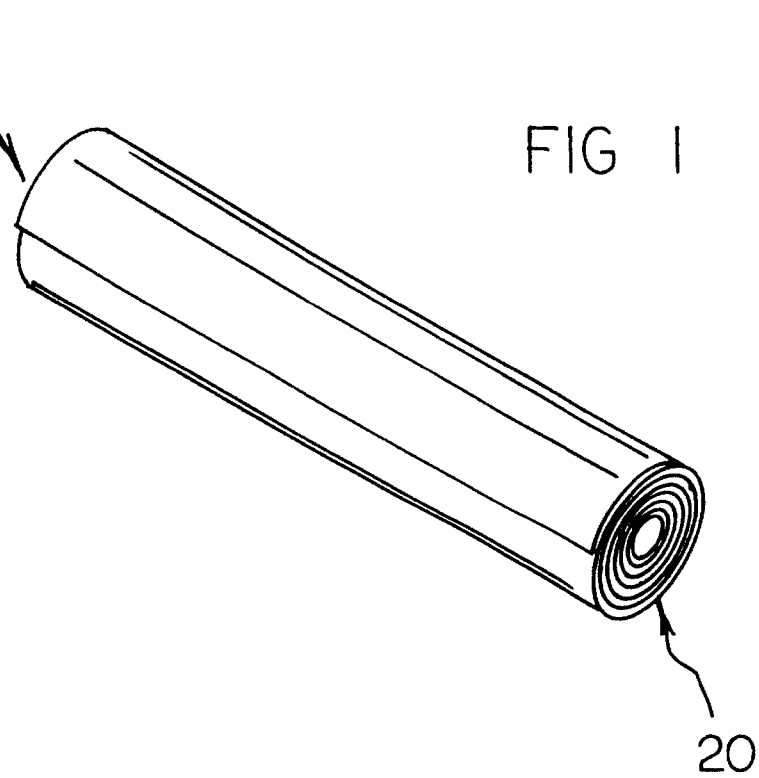
FIG. 1 is a perspective view showing a preferred embodiment of the disposable toilet seat cover apparatus of the invention in a fully rolled up condition.
Figure 2:
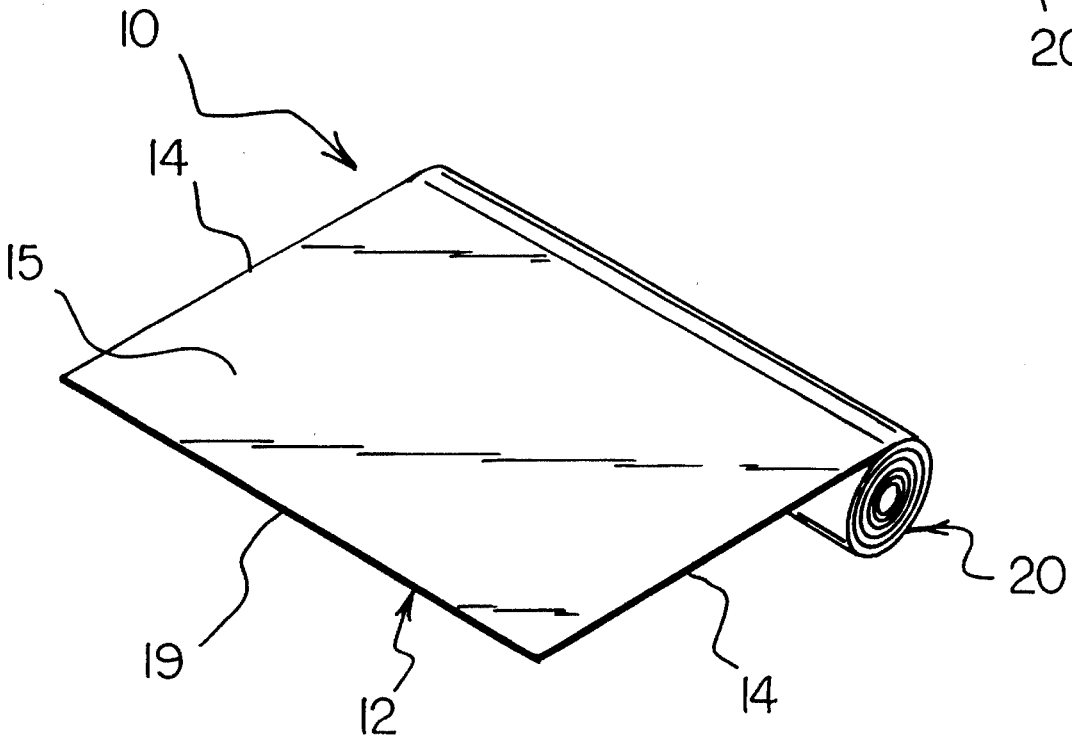
FIG. 2 is a perspective view of the embodiment of the invention shown in FIG. 1 with the disposable toilet seat cover apparatus of the invention in a partially unrolled condition.
Figure 3:
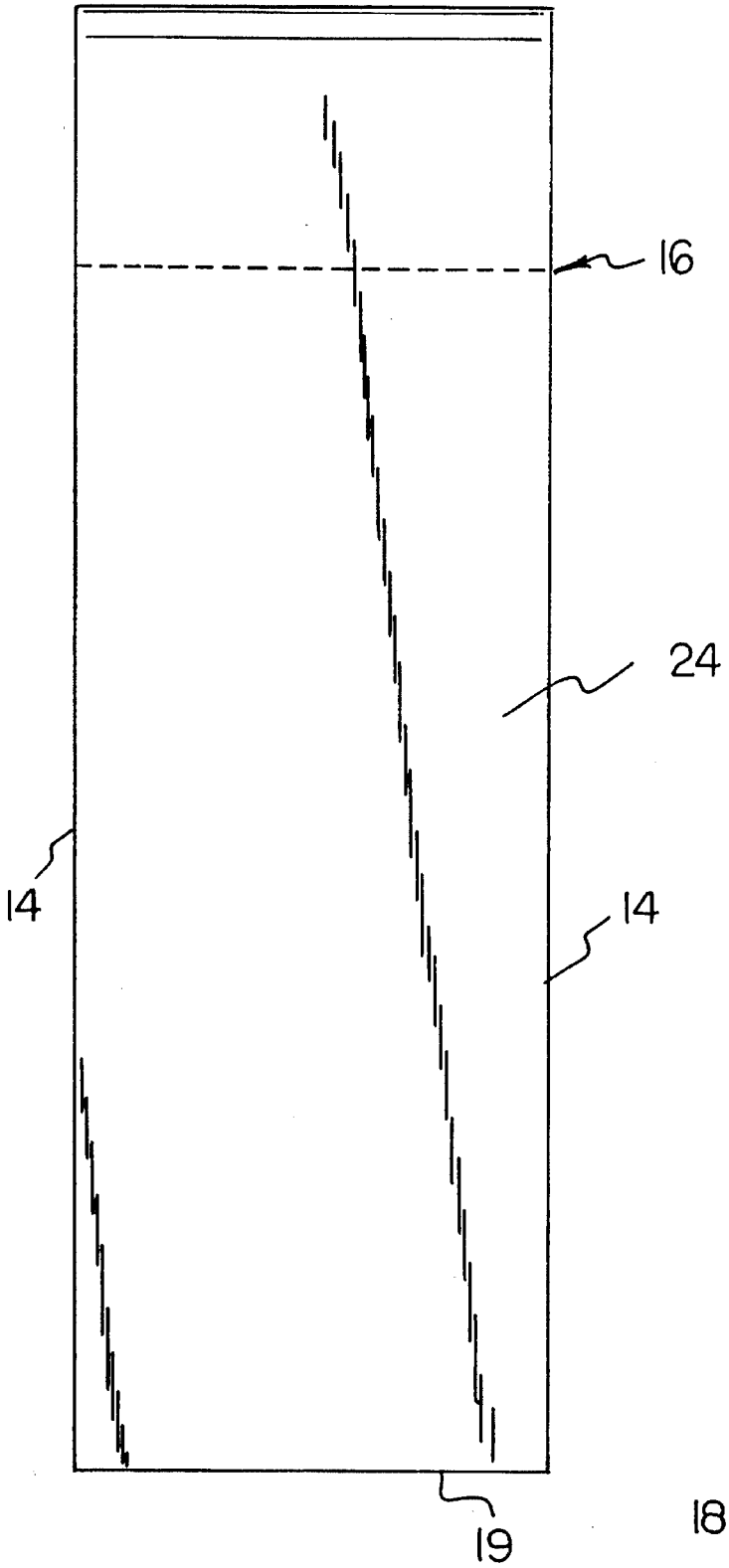
FIG. 3 is an enlarged top view of the embodiment of the invention shown in FIG. 2 in a still more unrolled condition.
Figure 4:
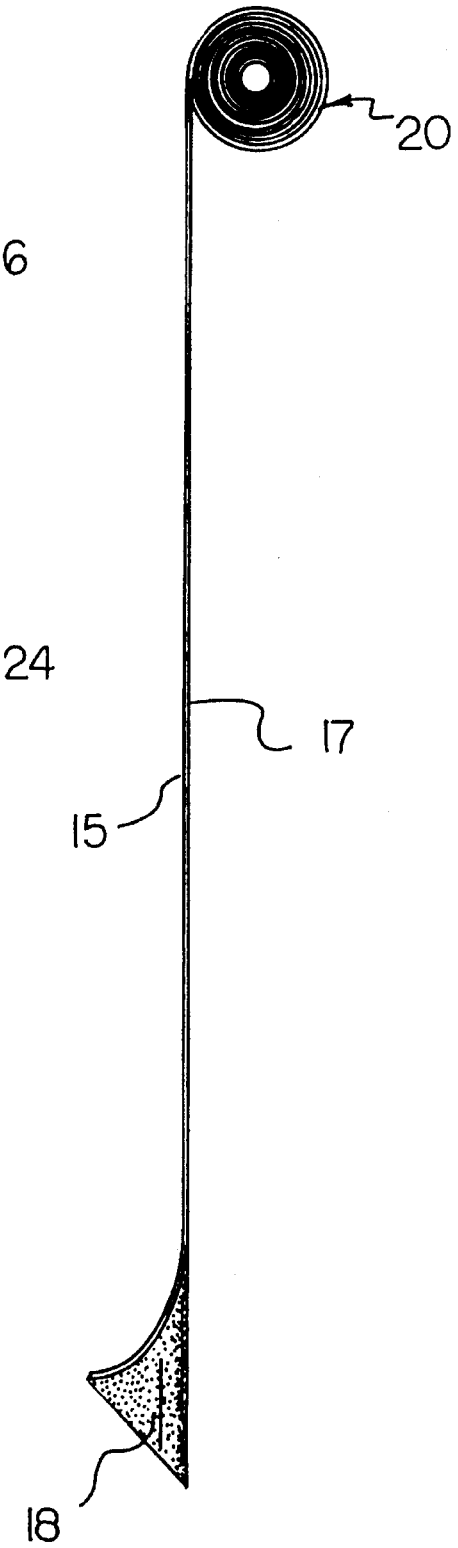
FIG. 4 is side view of the embodiment of the invention shown in FIG. 3 with an end portion of the unrolled material showing an adhesive-coated bottom side.

With reference to the drawings, a new and improved disposable toilet seat cover apparatus embodying the principles and concepts of the present invention will be described.

Turning to FIGS. 1–4, there is shown an exemplary embodiment of the disposable toilet seat cover apparatus of the invention generally designated by reference numeral 10. In its preferred form, disposable toilet seat cover apparatus 10 includes a continuous, flexible, biodegradable base sheet 12 which has two side edges 14, a leading edge 19, a top side 15, and a bottom side 17. The base sheet 12 includes a plurality of sets of perforations 16 positioned at predetermined intervals along the base sheet 12, wherein each set of the perforations 16 extends across the base sheet 12 from one side edge 14 to the other side edge 14. A coating of tacky adhesive 18 is placed on the bottom side 17 of the base sheet 12 and is coextensive with the bottom side 17 of the base sheet 12. The base sheet 12 with the tacky adhesive 18 on the bottom side 17 of the base sheet 12 is wound into a roll 20 whereby portions of the tacky adhesive 18 contact portions of the top side 15 of the base sheet 12. As a result, the roll 20 is maintained as a compact roll 20. The roll 20 is unrolled by pulling the leading edge 19 of the base sheet 12 away from the roll 20. The perforations 16 serve to divide the base sheet 12 into removable segments 24 that are used on top of a toilet seat which can be a horse-shoe shaped toilet seat 25 or a oval shaped toilet seat 35, among others. The removable segments are torn off of the roll 20 at the perforations 16.

The coating of tacky adhesive 18 is water repellent. More specifically, the tacky adhesive 18 is the same type of adhesive that is found on the note pads and self-stick removable notes products known collectively as POST-IT(TM), manufactured by the 3M Company, St. Paul, Minn. The width of the base sheet 12 is approximately equal to the width of standard toilet paper, which is approximately 4.5 inches. For convenience, the sets of perforations 16 are spaced at 15 inch intervals along the base sheet 12. The base sheet 12 is made from a relatively non-porous paper. This paper is biodegradable and breaks down in the sewage system when flushed. It is used in currently available disposable toilet seat covers.

Because only the bottom side 17 of the base sheet 12 is coated with the tacky adhesive 18, once the segments of the disposable toilet seat cover 10 of the invention that were used were flushed, they break apart easily. Also, because the bottom side 17 of the base sheet 12 is coated with the water repellent tacky adhesive 18, when using the segments of the disposable toilet seat cover apparatus 10 of the invention, it is not necessary for a person to clean off a wet or dirty toilet seat before using the toilet seat. In addition, the tacky adhesive 18 provides frictional resistance between segments of the disposable toilet seat cover apparatus 10 and the toilet seat.

Figure 5:
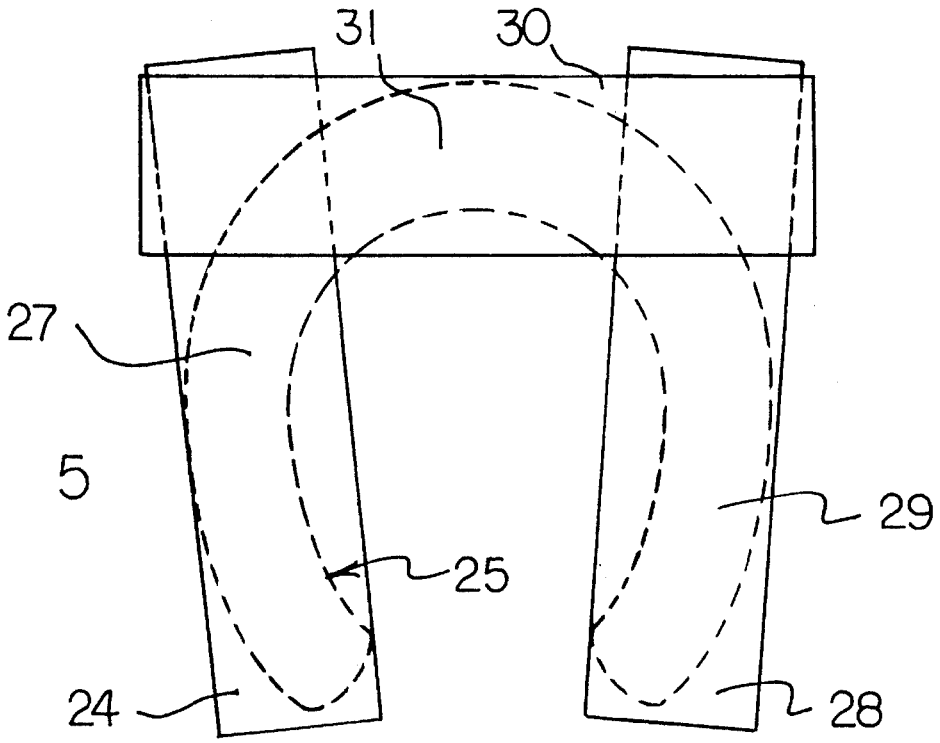
FIG. 5 is a top view of a horse-shoe shaped toilet seat covered with three strips of the embodiment of the invention shown in FIG. 4.

One way of using the disposable toilet seat cover apparatus of the invention is shown in FIG. 5 which depicts carrying out a method of covering a horse-shoe shaped toilet seat 25. The method includes the steps of obtaining a roll 20 of perforated disposable toilet seat cover segments 24 of the invention and tearing off a first disposable toilet seat cover segment 24 off of the roll 20. The first disposable toilet seat cover segment 24 is long enough to substantially cover a first side 27 of the horse-shoe shaped toilet seat 25. Then, the first disposable toilet seat cover segment 24 is placed on the first side 27 of the horse-shoe shaped toilet seat 25. A second disposable toilet seat cover segment 28 is torn off of the roll 20. The second disposable toilet seat cover segment 28 is long enough to substantially cover a second side 29 of the horse-shoe shaped toilet seat 25. The second disposable toilet seat cover segment 28 is placed on the second side 29 of the horse-shoe shaped toilet seat 25. Then, a third disposable toilet seat cover segment 30 is torn off of the roll 20. The third disposable toilet seat cover segment 30 is long enough to substantially cover a back side 31 of the horse-shoe shaped toilet seat 25. Then, the third disposable toilet seat cover segment 30 is placed on the back side 31 of the horse-shoe shaped toilet seat 25.

Figure 6:
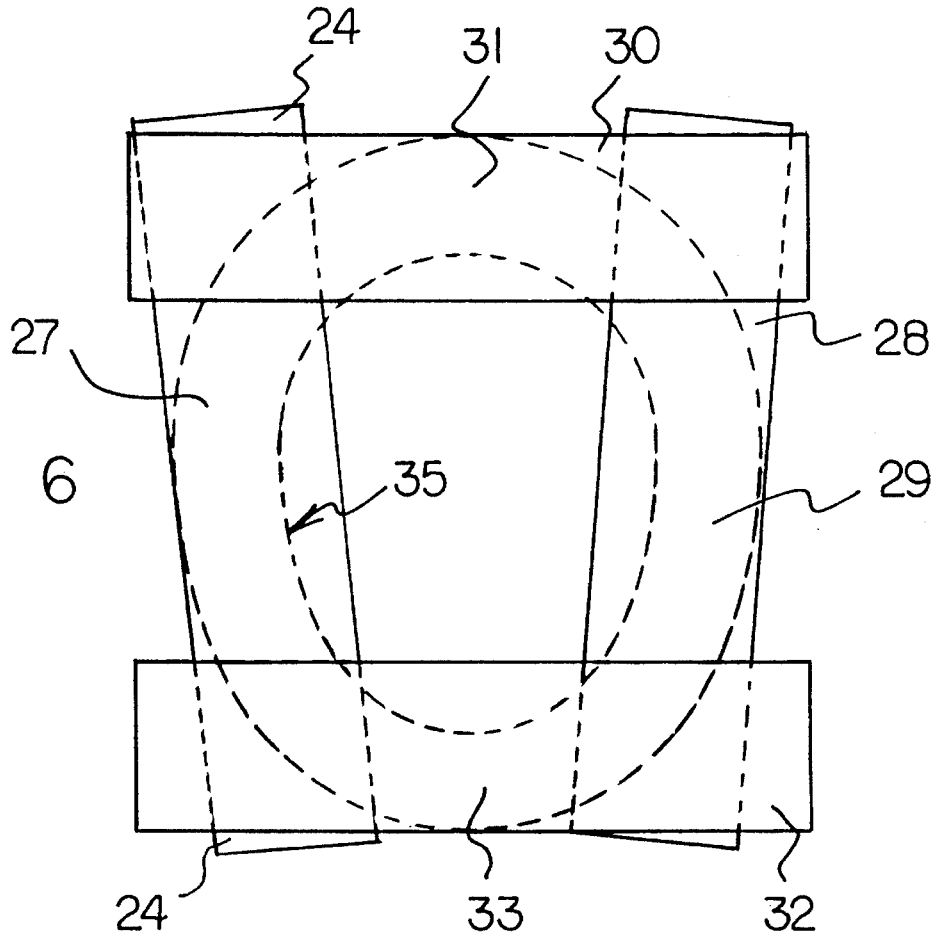
FIG. 6 is a top view of an oval shaped toilet seat covered with four strips of the embodiment of the invention shown in FIG. 4.

A second way of using the disposable toilet seat cover apparatus 10 of the invention is shown in FIG. 6 in which a method of covering an oval shaped toilet seat 35 is carried out. The method includes the steps of obtaining a roll 20 of perforated disposable toilet seat cover segments 24 of the invention and tearing off a first disposable toilet seat cover segment 24 off of the roll 20. The first disposable toilet seat cover segment 24 is long enough to substantially cover a first side 27 of the oval shaped toilet seat 35. The first disposable toilet seat cover segment 24 is placed on the first side 27 of the oval shaped toilet seat 35. Then, a second disposable toilet seat cover segment 28 is torn off of the roll 20. The second disposable toilet seat cover segment 28 is long enough to substantially cover a second side 29 of the oval shaped toilet seat 35. Then, the second disposable toilet seat cover segment 28 is placed on the second side 29 of the oval shaped toilet seat 35. Then, a third disposable toilet seat cover segment 30 is torn off of the roll 20. The third disposable toilet seat cover segment 30 is long enough to substantially cover a back side 31 of the oval shaped toilet seat 35. Then, the third disposable toilet seat cover segment 30 is placed on the back side 31 of the oval shaped toilet seat 35. Then, a fourth disposable toilet seat cover segment 32 is torn off of the roll 20. The fourth disposable toilet seat cover segment 32 is long enough to substantially cover a front side 33 of the oval shaped toilet seat 35. Then, the fourth disposable toilet seat cover segment 32 is placed on the front side 33 of the oval shaped toilet seat 35.

It is contemplated that a compact roll 20 of the disposable toilet seat cover 10 of the invention can be made that is convenient to carry in a pocket or purse. The disposable toilet seat covers 10 of the invention can be sold in dispensing machines in rest rooms and can be sold in grocery st, convenience st, and drug st. The paper can be made from a variety of colors and can have designs imprinted on it. The paper can also be scented if desired.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved disposable toilet seat cover apparatus that is low in cost, relatively simple in design and operation, and which may advantageously be used to cover a toilet seat without unfolding the toilet seat cover. With the invention, a disposable toilet seat cover apparatus is provided which prevents migration of liquids from the toilet seat to a person using the disposable toilet seat cover apparatus. With the invention, a disposable toilet seat cover apparatus provides a substantial frictional resistance against the toilet seat. With the invention, a disposable toilet seat cover apparatus is provided which is made from materials that break down when flushed. With the invention, a disposable toilet seat cover apparatus is provided which does not have a doughnut-shaped toilet seat cover. With the invention, a disposable toilet seat cover apparatus is provided which is easily portable and can readily be carried in a pocket, pocket book, or purse. With the invention, a disposable toilet seat cover apparatus is provided which does not require the use of non-stick barrier strips between adjacent strips of adhesive. With the invention, a disposable toilet seat cover apparatus is provided which employs a water-repellent adhesive applied extensively to one side of the toilet seat cover. With the invention, a disposable toilet seat cover apparatus provides a way of using a perforated paper for covering the middle of the front and the middle of the back of a toilet seat. With the invention, a disposable toilet seat cover apparatus is provided which has a provision for keeping a roll of paper tightly rolled. With the invention, a disposable toilet seat cover apparatus is provided which is readily removable from the toilet seat when it is time to separate the toilet seat cover from the toilet seat.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A disposable toilet seat cover apparatus, comprising:

a roll of continuous, flexible, biodegradable base sheet having two side edges, having a leading edge, having a top side, and having a bottom side, wherein said base sheet includes perforations positioned only at predetermined intervals along said base sheet, the length of each interval being equal to about three times the width of said roll, wherein each perforation extends across said base sheet from one side edge to the other side edge, and a coating of tacky adhesive placed on said bottom side of said base sheet and coextensive with said bottom side of said base sheet, wherein said base sheet with said tacky adhesive on said bottom side of said base sheet is wound into a roll whereby portions of said tacky adhesive contact portions of said top side of said base sheet, whereby said roll is maintained as a roll, and wherein said roll is unrolled by pulling said leading edge of said base sheet away from said roll, wherein said coating of tacky adhesive is water repellent, wherein said base sheet is made from a relatively non-porous paper.

2. The disposable toilet seat cover apparatus of claim 1 wherein said perforations are spaced apart about 15 inches and said width of said roll is about 4.5 inches.

* * * * *